US007000341B2

(12) United States Patent
Ho

(10) Patent No.: US 7,000,341 B2
(45) Date of Patent: Feb. 21, 2006

(54) SANDWICH PRESS DEVICE FOR IRONING CLOTHES

(76) Inventor: Myong H Ho, 356 Warren Blvd., Broomall, PA (US) 19008

( * ) Notice: Subject to any disclaimer, the term of this patent is extended or adjusted under 35 U.S.C. 154(b) by 0 days.

(21) Appl. No.: 11/022,788

(22) Filed: Dec. 28, 2004

(65) Prior Publication Data

US 2005/0150145 A1 Jul. 14, 2005

(30) Foreign Application Priority Data

Jan. 14, 2004 (KR) ..... 20-2004-0001023 U

(51) Int. Cl.
*D06F 71/28* (2006.01)

(52) U.S. Cl. ..... 38/70; 38/66

(58) Field of Classification Search ..... 38/2, 38/12, 14, 16, 63, 64, 66, 69, 70, 71, 1 B, 38/96, 104, 106, 108, 140; 242/371, 377, 242/379, 400

See application file for complete search history.

(56) References Cited

U.S. PATENT DOCUMENTS

| | | | | | |
|---|---|---|---|---|---|
| 1,486,433 | A * | 3/1924 | Hogan | ..... | 38/71 |
| 1,663,069 | A * | 3/1928 | Diener | ..... | 38/12 |
| 1,908,111 | A * | 5/1933 | Brockett | ..... | 38/12 |
| 3,665,624 | A * | 5/1972 | Briddell | ..... | 38/71 |
| 5,335,431 | A * | 8/1994 | Ohnishi | ..... | 38/1 B |

* cited by examiner

*Primary Examiner*—Ismael Izaguirre
(74) *Attorney, Agent, or Firm*—Robert E. Bushnell, Esq.

(57) ABSTRACT

Disclosed is a sandwich press device used together with an ironing device having an ironing board installed on a table in order to retain trousers and a pressing plate rotatably placed above the ironing board in order to iron out wrinkles in the trousers while spraying steam onto the trousers. The sandwich press device includes a plate having a rectangular shape, a winding section for winding the plate, a support rod for supporting the plate and the winding section, a base plate provided at an upper surface thereof with a hollow cylinder into which the support rod is slidably inserted, a height adjustment screw for fixing the support rod to the hollow cylinder, an iron seat positioned at upper end of the support rod, and a support wire connected to the iron seat and having a coil shape. The sandwich press device improves efficiency of ironing.

3 Claims, 2 Drawing Sheets

SANDWICH PRESS DEVICE FOR IRONING CLOTHES

CLAIM OF PRIORITY

This application makes reference to, incorporates the same herein, and claims all benefits accruing under 35 U.S.C. § 119 from an application earlier filed in the Korean Intellectual Property Office on Jan. 14, 2004 and there duly assigned Serial No. 2004-1023.

BACKGROUND OF THE INVENTION

1. Field of the Invention

The present invention relates to a sandwich press device used together with an ironing device in order to iron out wrinkles in trousers at a time.

2. Description of the Prior Art

As generally known in the art, a conventional ironing device includes an ironing board installed on a table in order to retain clothes, such as trousers, and a pressing plate rotatably placed above the ironing board in order to iron out wrinkles in the clothes while spraying steam onto the clothes. When ironing out wrinkles in trousers using the conventional ironing device, one of trouser legs is firstly placed on the ironing board and the pressing plate presses the trouser leg placed on the ironing board so as to iron out wrinkles in the trouser leg. After that, the other trouser leg is placed on the ironing board and the pressing plate presses the other trouser leg so as to iron out wrinkles in the other trouser leg. That is, the trouser legs must be alternately placed on the ironing board one by one when ironing out wrinkles in trousers, causing a user to be cumbersome.

Thus, the conventional ironing device is very inefficient and is not adaptable for a laundry in which ironing is carried out with respect to a great amount of trousers.

SUMMARY OF THE INVENTION

Accordingly, the present invention has been made to solve the above-mentioned problems occurring in the prior art, and an object of the present invention is to provide a sandwich press device used together with an ironing device in order to iron out wrinkles in trousers at a time by using an ironing board.

To accomplish the above object, according to the present invention, there is provided a sandwich press device used together with an ironing device having an ironing board installed on a table in order to retain trousers and a pressing plate rotatably placed above the ironing board in order to iron out wrinkles in the trousers while spraying steam onto the trousers. This sandwich press device may be constructed with a plate having a rectangular shape; a winding section for winding the plate; a support rod for supporting the plate and the winding section; a base plate provided at an upper surface thereof with a hollow cylinder into which the support rod is slidably inserted; a height adjustment screw for fixing the support rod to the hollow cylinder; an iron seat positioned at upper end of the support rod; and a support wire connected to the iron seat and having a coil shape.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Hereinafter, a preferred embodiment of the present invention will be described with reference to the accompanying drawings.

Figure 1:
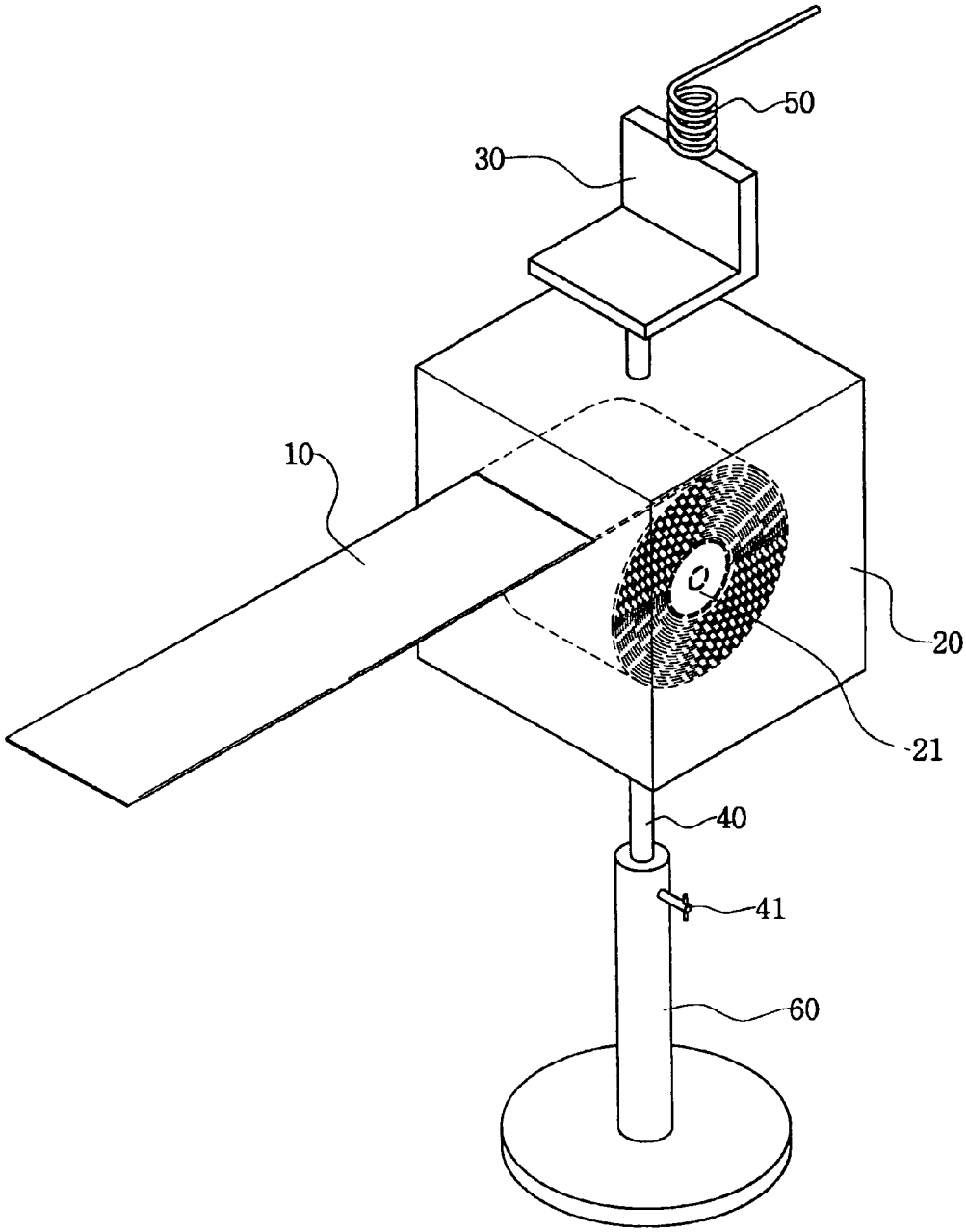
FIG. 1 is a perspective view showing a sandwich press device according to one embodiment of the present invention.

FIG. 1 is a perspective view showing a sandwich press device according to one embodiment of the present invention.

Figure 2:
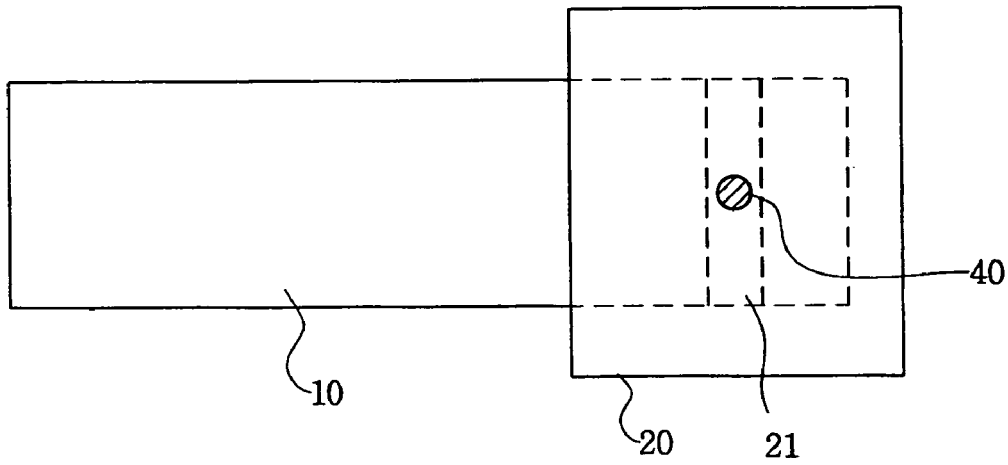
FIG. 2 is a plan view showing a plate and a winding section.

FIG. 2 is a plan view showing a plate 10 and a winding section 20. In use, a predetermined part of the plate 10 installed in the winding section 20 comes out of the winding section 20. If the plate 10 has been used, the plate 10 returns to its initial position in the winding section 20 by means of a winding unit 21 provided in the winding section 20.

The plate 10 has a size capable of covering one trouser leg. Preferably, the size of the plate 10 is equal to a size of a pressing plate of an ironing device. More preferably, the plate 10 has a mesh structure so as to easily transfer heat and pressure of the pressing plate to the trouser leg placed below the plate 10. The plate 10 is made from a material having endurance against heat and having predetermined elasticity such that the plate 10 is easily wound around the winding unit 21 of the winding section 20.

The winding unit 21 of the winding section 20 may include a leaf spring, a coil spring, a cam/rack gear and air cylinder assembly, or a micro motor in order to rewound the plate 10 around the winding unit 21 after the plate 10 has been used.

When the leaf spring or the coil spring is used as the winding unit 21, the plate 10 must be manually wound around the winding unit 21. In contrary, if the cam, the rack gear or the micro motor is used as the winding unit 21, the winding unit 21 can automatically wind the plate 10 when ironing for trousers has been finished by electrically connecting the winding unit 21 to the ironing device. Therefore, in a state in which the cam, the rack gear or the micro motor is used as the winding unit 21, if the leaf spring or the coil spring is additionally installed in the winding section 20, it is possible to manually wind the plate 10 around the winding unit 21 when the winding unit 21 malfunctions.

Positions of the plate 10 and the winding section 20 may be adjusted according to a position of the ironing board. That is, the height of the plate 10 and the winding section 20 is adjustable by vertically shifting a position of a support rod 40 slidably inserted into a hollow cylinder 60 formed on a base plate and fixing the support rod 40 by means of an adjustment screw 41.

An iron seat 30 is provided to place an iron thereon. That is, after ironing out wrinkles in trousers by using the pressing plate of the ironing device, the user may further iron out a detailed part of trousers by using the iron placed on the iron seat 30.

A support wire 50 provided at an upper portion of the iron seat 50 is used for suspending an electric wire of the iron. That is, the support wire 50 may support the electric wire of the iron connected to a wall outlet, so that detailed iron work is possible.

As described above, the sandwich press device of the present invention is used together with the ironing device so as to rapidly and simply perform ironing for trousers with high efficiency.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A sandwich press device used together with an ironing device having an ironing board installed on a table in order to retain trousers and a pressing plate rotatably placed above the ironing board in order to iron out wrinkles in the trousers while spraying steam onto the trousers, the sandwich press device, comprising:

a plate having a rectangular shape;

a winding section for winding the plate;

a support rod for supporting the plate and the winding section;

a base plate provided at an upper surface thereof with a hollow cylinder into which the support rod is slidably inserted;

a height adjustment screw for fixing the support rod to the hollow cylinder;

an iron seat positioned at upper end of the support rod; and a support wire connected to the iron seat and having a coil shape.

2. The sandwich press device as claimed in claim 1, wherein the plate has a mesh structure.

3. The sandwich press device as claimed in claim 1, wherein a winding section has a winding unit including a leaf spring, a coil spring, a cam/rack gear and air cylinder assembly, or a micro motor.

* * * * *